United States Patent [19]

Kobler

[11] Patent Number: 4,795,372

[45] Date of Patent: Jan. 3, 1989

[54] INSERT MEANS FOR EFFECTIVE SEAL OF ELECTRICAL CONNECTOR AND METHOD OF ASSEMBLY THEREFOR

[75] Inventor: Robert J. Kobler, Harrisburg, Pa.

[73] Assignee: AMP Incorporated, Harrisburg, Pa.

[21] Appl. No.: 225,651

[22] Filed: Jul. 25, 1988

Related U.S. Application Data

[63] Continuation of Ser. No. 45,919, Apr. 30, 1987, abandoned.

[51] Int. Cl.[4] ..... H01R 4/66

[52] U.S. Cl. ..... 439/607; 439/736

[58] Field of Search ..... 439/271–277, 439/587–589, 597–601, 607, 620, 736; 29/854–857, 883

[56] References Cited

U.S. PATENT DOCUMENTS

| | | | |
|---|---|---|---|
| 3,521,823 | 7/1970 | Van Horssen | 339/218 |
| 3,840,841 | 10/1974 | Clark | 439/589 |
| 3,961,294 | 6/1976 | Hollyday | 333/79 |
| 3,970,352 | 7/1976 | Dorrell et al. | 439/276 |
| 4,131,331 | 12/1978 | Kendall, Jr. | 339/126 RS |
| 4,241,967 | 12/1980 | Collins | 339/59 M |
| 4,276,523 | 6/1981 | Boutros et al. | 339/143 R |
| 4,420,210 | 12/1983 | Karol et al. | 439/271 |
| 4,484,159 | 11/1984 | Whitley | 333/182 |
| 4,679,013 | 7/1987 | Farrar et al. | 439/620 |

OTHER PUBLICATIONS

"ARINC 404 Rack & Panel Connectors", AMP Catalog.

Drawing, "Filtered ARINC Receptacle Ass'y", AMP Incorporated, Harrisburg, Pa.

*Primary Examiner*—Joseph H. McGlynn

*Attorney, Agent, or Firm*—Katherine A. Nelson

[57] ABSTRACT

An effective seal is provided for an electrical connector (10) by means of a substantially-rigid molded plastic insert (13) received in the housing (11) for the electrical connector (10). A potting compound (19) is injected, preferably through an opening in the base portion (14) of the insert (13), and into the space between the base portion (14) of the insert and the bottom wall of a casing (24) which supports a plurality of spaced-apart terminals (12) encapsulated by the potting compound (19). An interfacial seal (20) comprising an elastomeric sealing member is disposed flush against the base portion (14) of the insert (13), opposite to the potting compound (19). The insert (13) substantially compensates for any indentations in the potting compound (19) resulting from the curing thereof and provides an essentially flat support surface for interfacial seal (20) when connector (10) is mated to a complementary connector thus enabling an effective seal to be achieved between the two mated connectors and precludes the build-up of moisture in the indentations.

20 Claims, 4 Drawing Sheets

INSERT MEANS FOR EFFECTIVE SEAL OF ELECTRICAL CONNECTOR AND METHOD OF ASSEMBLY THEREFOR

This application is a Continuation of Application Ser. No. 07/045,919 filed 4/30/87, now abandoned.

FIELD OF THE INVENTION

The present invention relates to a sealing means for an electrical connector, and more particularly, to an improved means for assuring a substantially-flat engagement between a flexible substantially-flat elastomeric sealing member and a potting compound used for encapsulating the terminals within the connector.

BACKGROUND OF THE INVENTION

In the prior art relating to an electrical connector, wherein a plurality of spaced-apart terminals are disposed within a housing for the connector, it is a conventional practice to encapsulate the terminals with a suitable potting compound, such as an epoxy. Encapsulation is generally used to environmentally seal a variety of connectors. The connectors include filtered as well as unfiltered terminals. Encapsulation also provides protection for the terminals if the connector is subjected to vibration during use. It is particularly desirable to encapsulate filtered terminals to protect filter members which are usually comprised of ceramic material. After the terminals have been so encapsulated, a substantially-flat elastomeric sealing member (referred to in the art as an "interfacial seal") is disposed against the potting compound, adjacent the mating face of the connector. The interfacial seal has a plurality of spaced-apart openings to receive the terminals, respectively. The interfacial seal is used to seal the interconnection with a complementary mating connector.

When the potting compound cures, its surface is not completely flat, but rather has a plurality of "dimples" or indentations. When the interfacial seal is disposed against the potting compound, some minute crevices or pockets are formed due to the irregular dimpled surface of the potting compound. As a result, it is difficult to obtain a good effective seal between the mating connectors. In addition moisture can accumulate within the crevices or indentations, thereby leading to undesired corrosion of the terminals within the connector.

SUMMARY OF THE INVENTION

Accordingly, it is an object of the present invention to alleviate the disadvantages and deficiencies of the prior art by providing an insert for the potting compound, thereby assuring a substantially-flat effective sealing engagement between the potting compound and the interfacial seal and between the interfacial seal and the mating connector.

It is another object of the present invention to provide an insert within which the potting compound is received and cured, together with a means for injecting the potting compound into the insert.

It is yet another object of the present invention to provide an improved sealing engagement, conveniently, and in a cost effective manner.

In accordance with the broad teachings of the present invention, there is herein illustrated and described, and for use in an electrical connector including a housing having a plurality of spaced-apart substantially-parallel terminals mounted therein, an insert disposed within the housing. The insert has a base portion provided with a plurality of spaced-apart openings to receive the terminals, respectively. The base portion of the insert has first and second sides, and the insert further has a peripheral skirt portion extending from the first side of the base portion thereof. A potting compound encapsulates the terminals within the skirt portion of the insert and is substantially flush against the first side of the base portion thereof. An interfacial seal has a plurality of spaced-apart openings formed therein for the terminals. The interfacial seal is disposed substantially flat against the second side of the base portion of the insert. With this structural arrangement, an effective seal is provided, thereby precluding moisture from accumulating within the potting compound.

In a preferred embodiment, the housing has an internal peripheral rib formed therein, such that the skirt portion of the insert is seated on the peripheral rib in the housing. The base portion of the insert has an opening formed therein, such that the potting compound may be inserted from the second side of the base portion of the insert. The terminals having filter sleeves disposed thereon, are mounted in a casing or second housing portion having a peripheral flange portion secured to the housing. This peripheral flange portion covers the insert and the potting compound therein. The first and second housing members in the preferred embodiment are metal to provide grounding for the filter members. Preferably, the potting compound comprises an epoxy; and the interfacial seal which is substantially flat on one side and has terminal sealing portions on the other, is flexible and is molded from an elastomeric material.

In accordance with another aspect of the present invention, there is provided the combination of a housing having a plurality of spaced-apart substantially-parallel terminals disposed therein, each terminal having a filter sleeve member disposed thereon, the filter sleeves being grounded through a metal casing having a flanged bottom wall secured to the housing. An insert is disposed within the housing. The insert has a base portion provided with a plurality of spaced-apart openings to receive the terminals, respectively, and the insert further has a peripheral skirt portion extending from the base portion of the insert to the bottom wall of the casing. A potting compound encapsulates the terminals within the skirt portion of the insert and substantially between the base portion of the insert and the bottom wall of the casing, thereby precluding moisture from accumulating within the potting compound.

In accordance with the further teachings of the present invention, there is herein illustrated and described, an improved method for encapsulating an electrical connector of the type having a housing and further having at least one filtered terminal disposed therein, the terminal and filter sleeve being disposed in and supported by a metal casing. A substantially-rigid insert is provided, which is made from an electrically insulating material. The insert is seated within the housing, such that the terminal is received through a respective opening formed in the insert; and the casing is secured to the housing. A potting compound is injected into the housing and into the space between the insert and the casing, such that the potting compound encapsulates the terminal and its associated filter sleeve. An interfacial seal (preferably constituting an elastomeric sealing member) is provided and is disposed within the housing. The interfacial seal is substantially flush against the insert and on the other side thereof from the potting compound. As a result, an effective seal is provided between the insert and the interfacial seal, thereby compensating for any indentations formed in the potting compound during the curing thereof, and thereby precluding the accumulation of moisture within the indentations. The insert furthermore provides a flat support surface for the interfacial seal when the connector is mated with a complementary connector thus assuring effective sealing at the interface of the two connectors.

In accordance with the still further teachings of the present invention, there is herein illustrated and described, an improved method of assembly for an electrical connector. The method includes the step of providing a casing having a plurality of spaced-apart terminals carried thereby, such that the terminals project above and below a bottom wall of the casing. An insert is provided which has a base portion and further has a skirt portion extending upwardly of its base portion. The skirt portion of the insert is secured to the bottom wall of the casing, such that the plurality of terminals projecting below the bottom wall of the casing extend through a corresponding plurality of openings formed in the base portion of the insert. A housing is provided, and the casing is secured to the housing such that the insert is disposed at least partially within the housing. A potting compound is injected into the space between the base portion of the insert and the bottom wall of the casing for encapsulating the terminals. An interfacial seal is provided and is disposed within the housing and substantially flush against the base portion of the insert on the side thereof opposite to the potting compound. With this method, an effective seal is provided to compensate for any indentations formed in the curing of the potting compound, thereby ensuring an effective seal between mating connectors and precluding the accumulation of moisture within the indentations.

Preferably, the casing is secured to the housing by an adhesive, such that upon the application of heat thereto, the insert and casing subassembly may be removed from the housing, thereby facilitating testing and repair of the connector. For filtered connectors, it is preferred that the adhesive be conductive to provide a ground path for the filter members through the base of the casing to the housing.

These and other objects of the present invention will become apparent by way of example from a reading of the following specification, taken in conjunction with the enclosed drawings.

BRIEF DESCRIPTION OF THE DRAWINGS

More specifically, FIG. 4 illustrates the insert of the present invention being seated within the housing of the connector assembly.

FIG. 5 illustrates the plurality of terminals mounted in a casing having a peripheral flange portion, the flange portion of the casing being secured to the housing, and the casing subsequently covering the insert and the potting compound therein.

FIG. 6 illustrates the subsequent step of injecting a potting compound through an opening in the base portion of the insert.

FIG. 7 illustrates the further subsequent step of mounting the interfacial seal within the housing of the electrical connector, such that the interfacial seal is disposed substantially flat against the base portion of the insert, thereby providing an effective seal to prevent moisture build-up.

DETAILED DESCRIPTION OF THE PREFERRED EMBODIMENT

Figure 1:
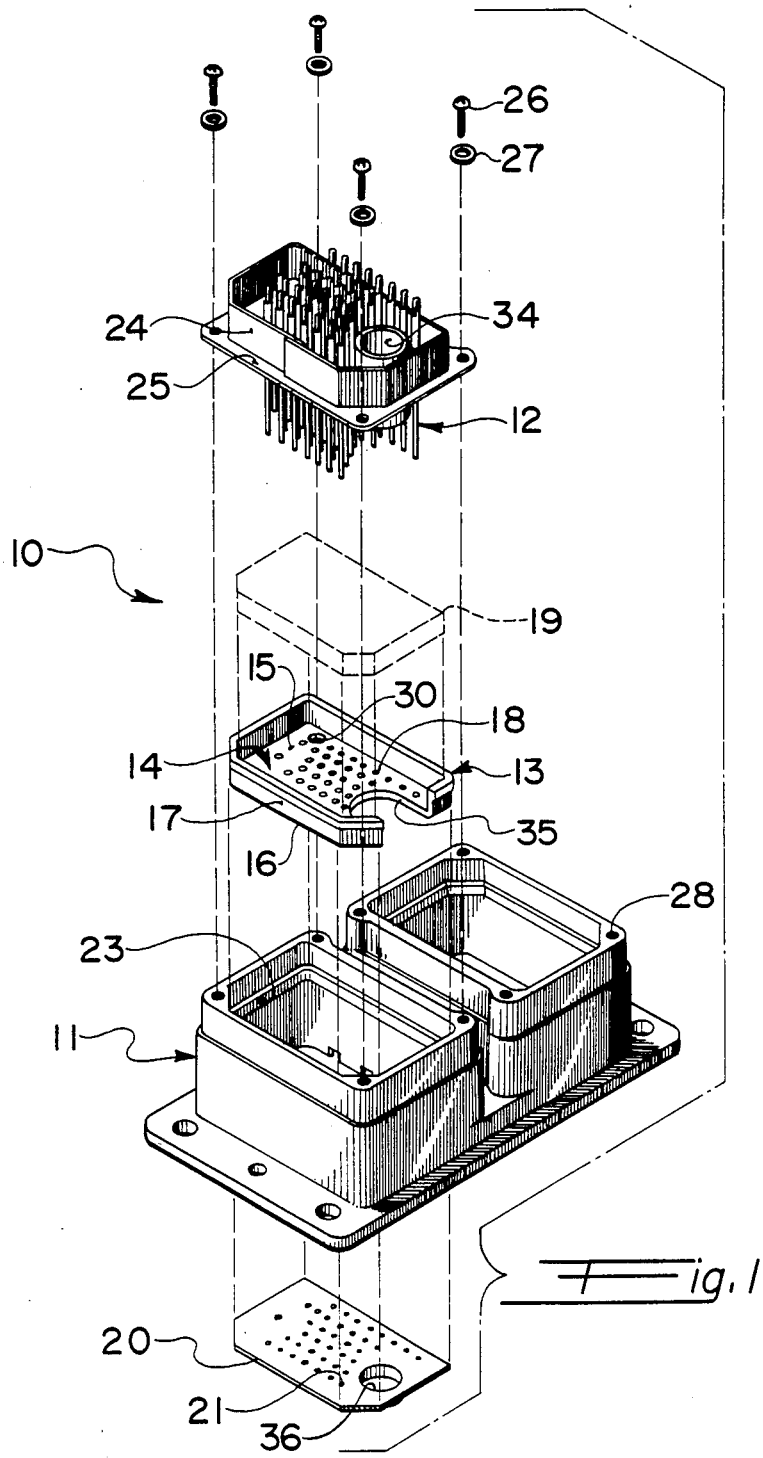
FIG. 1 an exploded perspective view, showing the insert in relation to the other components in the assembly of the electrical connector, the broken lines indicating the potting compound.

With reference to the drawings, an electrical connector 10 includes a housing 11 having a plurality of spaced-apart substantially-parallel terminals 12 mounted therein. In the preferred embodiment housing 11 is metal and terminals 12 have filter sleeves **12*a*** disposed thereon. A variety of sizes and types of filter sleeves as known in the art may be used. It is to be understood, however, that the present invention may be used with unfiltered terminals as well.

An insert 13 is disposed within the housing. The insert 13 preferably constitutes a relatively-rigid molded dielectric member, and preferably in the form of a small tray as shown more clearly in FIGS. 1 and 3. The insert 13 includes a base portion 14 having a first side 15 and a second side 16, respectively. The insert 13 further includes a peripheral skirt portion 17 formed integrally with the base portion 14 and extending from the first side 15 thereof. The base portion 14 of the insert 13 has a plurality of openings 18 formed therein to receive the respective terminals 12, as shown more clearly in FIGS. 1–3.

A potting compound 19 encapsulates the terminals 12 and filter sleeves **12*a* within the skirt portion 17 of the insert 13, and the potting compound 19 is substantially flush against the first side 15 of the base portion 14 of the insert 13**. The potting compound may be a well-known epoxy material used conventionally for encapsulation of electronic components.

An interfacial seal 20 has a plurality of openings 21 formed therein for receiving the terminals 12. The interfacial seal 20 is preferably a relatively-flexible flat member molded from a suitable elastomeric material; and in the final assembly, the interfacial seal 20 is disposed substantially flush (or flat) against the second side 16 of the base portion 14 of the insert 13. Interfacial seal 20 preferably includes terminal sealing portions 21*a* which extend outwardly and surround openings 21.

Figure 3:
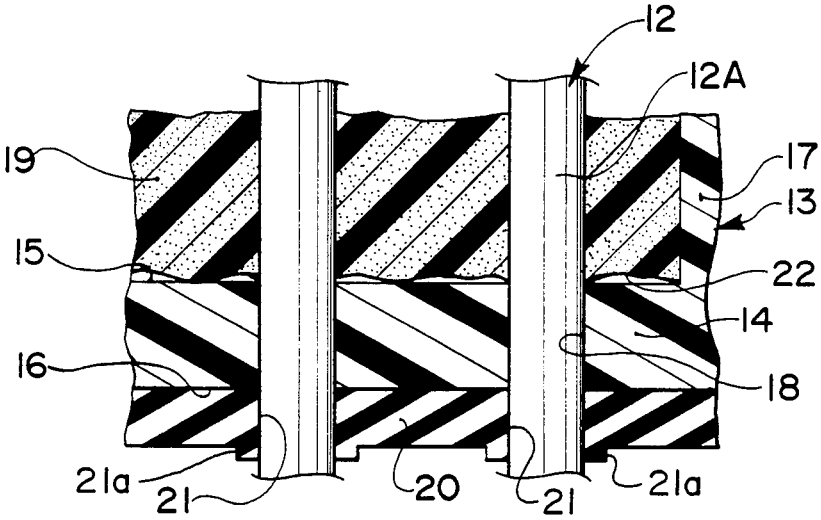
FIG. 3 is a portion of FIG. 2, drawn to an enlarged scale, and showing the effective sealing means between the interfacial seal and the base portion of the insert, thereby compensating for any indentations formed in the potting compound during the curing thereof, and thereby assuring a good effective seal to prevent substantial build-up of moisture.

When the epoxy potting compound 19 cures, it invariably results in a plurality of "dimples", pockets or indentations 22 on the surface thereof, as shown more clearly in FIG. 3. Thus, when the interfacial seal 20 is placed against the exposed surface of the cured potting compound 19 (without the benefit of the present invention) an imperfect seal is formed. Portions of seal 20 may move into the indentions when the potted connector is mated with a complementary connector. As a result, moisture may tend to accumulate in the indentations 22 between the potting compound 19 and the interfacial seal 20, thus possibly contributing ultimately to corrosion of the terminals 12.

However, with the structural arrangement of the present invention, including the insert 13, an excellent seal is provided to support the interfacial seal member to preclude the accumulation of moisture within the potting compound 19, thereby essentially eliminating the likelihood of corrosion of the terminals 12 or damage to the electrical integrity of the connector.

Figure 2:
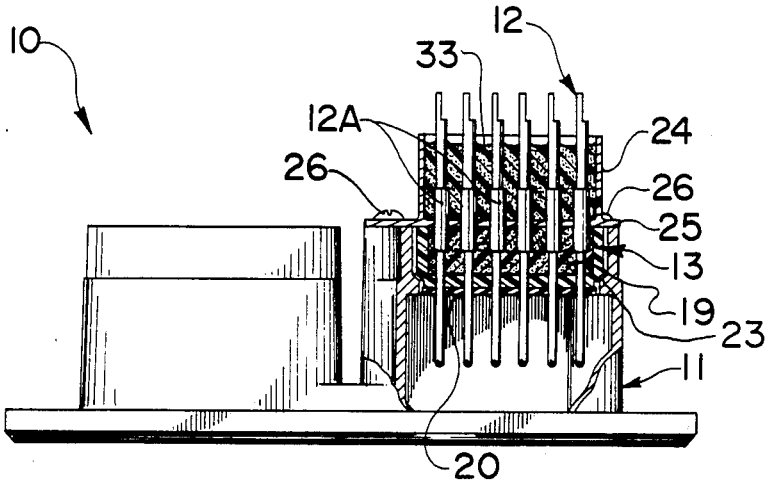
FIG. 2 is a longitudinal section of the electrical connector, with certain parts broken away and sectioned.
Figure 4:
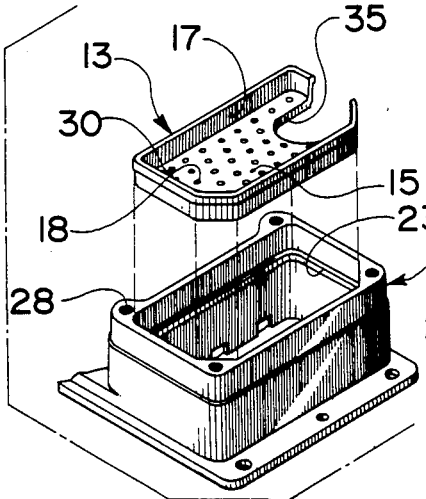
FIGS. 4–7 illustrate the sequence of assembly of the major components of the electrical connector assembly.
Figure 6:
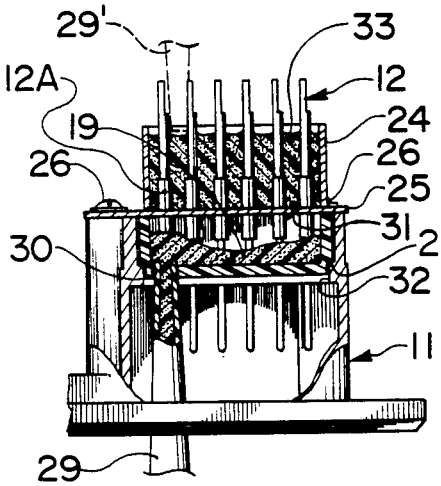

Preferably, the housing 11 has an internal peripheral rib 23 formed therein, as shown more clearly in FIG. 4; and the skirt portion 17 of the insert 13 is seated thereon, as shown more clearly in FIGS. 2 and 6. The base portion 14 of the insert 13 has an opening 30 formed therein, such that the potting compound 19 may be inserted from the second side 16 of the base portion 14 of the insert 13 (as hereinafter described with reference to FIG. 6). Moreover, the terminals 12 are preferably mounted in a casing 24 having a peripheral flange portion 25 formed integrally therewith. In the preferred embodiment casing 24 is metal or other conductive material and provides a grounding means for the filter sleeve members 12*a*. The peripheral flange portion 25 of the casing 24 is secured to the housing 11 by means of a plurality of screws 26. The screws 26 carry locking washers 27 and are received in respective tapped recesses 28 formed in the housing 11. Preferably housing 11 and securing means 26 are conductive to provide a ground path for the sleeves.

With reference to FIGS. 4–7, the sequence of assembly of the electrical connector 10 is described. In FIG. 4, the insert 13 is positioned within the housing 11, such that the peripheral skirt portion 17 of the insert 13 is received on the peripheral rib 23 formed internally within the housing 11.

Figure 5:
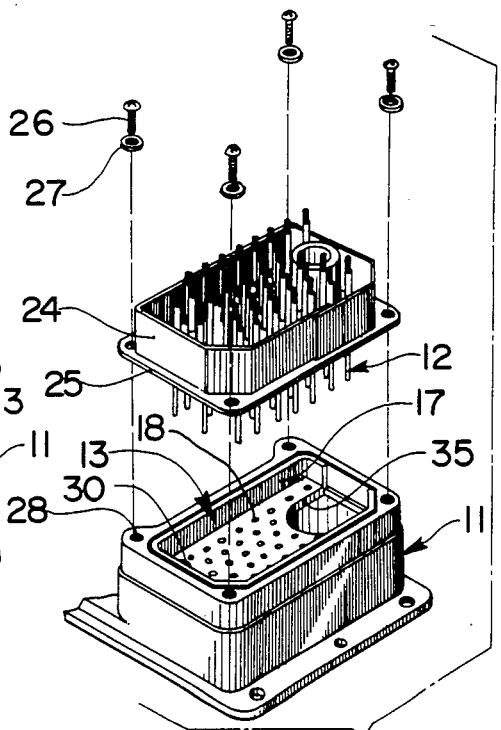

Next, and as shown more clearly in FIG. 5, the plurality of terminals 12 carried within the casing 24 is received within the housing 11, such that the terminals 12 pass through the respective openings 18 formed in the base portion 14 of the insert 13, and such that the flange 25 on the casing 24 rests upon the housing 11. Thereafter, the flange 25 on the casing 24 is secured to the housing 11 by means of the screws 26 received in the tapped recesses 28 formed in the housing 11.

Thereafter, and as shown more clearly in FIG. 6, casing 24 and insert 13 are filled with epoxy compound 33, 19 respectively to encapsulate terminals 12. Preferably this is done in a two stage operation so that the epoxy compound flows down into the receiving cavity. The epoxy in the first cavity is cured before the connector 10 is turned to receive the potting in the second cavity. Epoxy potting compound 33 is injected by a nozzle 29' into casing 24. Epoxy potting compound 19 is injected by means of a nozzle 29 into insert 13. The nozzle 29 is received through an opening 30 in the base portion 14 of the insert 13, such that the potting compound 19 is received around the terminals 12 and in the space between the bottom wall 31 of the casing 24 and the base portion 14 of the insert 13. Alternatively, the potting compound could be inserted from the other side of the insert 13 if fill holes were provided for such in the base of casing 24.

Figure 7:
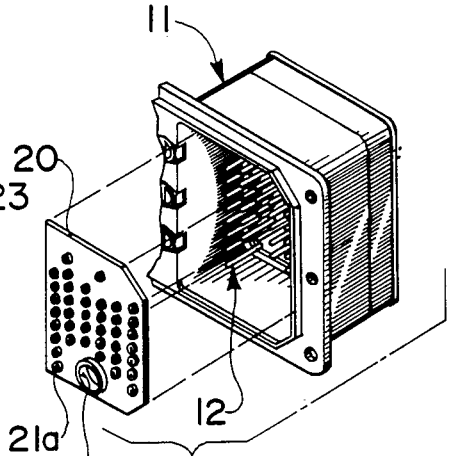

Next, and as shown more clearly in FIG. 7, the interfacial seal 20 is received substantially flat against the second side 16 of the base portion 14 of the insert 13 and in a recess 32 formed internally within the housing 11. The terminals 12 project through the openings 21 in the interfacial seal 20, as shown more clearly in FIGS. 2 and 3, to thereby form the desired effective seal as hereinbefore described.

With the benefit of the present invention, an excellent seal is obtained, since the insert substantially compensates for the pockets or indentations 22 resulting from the curing of the potting compound 19, thereby providing solid support for interfacial seal 20 and precluding the accumulation of moisture within the electrical connector 10 and the possible corrosion of the terminals 12 resulting therefrom.

With reference again to FIG. 1, the casing 24 of the electrical connector 10 includes an integrally formed sleeve 34 which is in substantial alignment with an aperture 35 formed in the insert 13 and with an aperture 36 in the elastomeric seal 20, thereby accommodating an interconnection with the coaxial cable (which, being conventional, has been omitted for ease of illustration).

Figure 8:
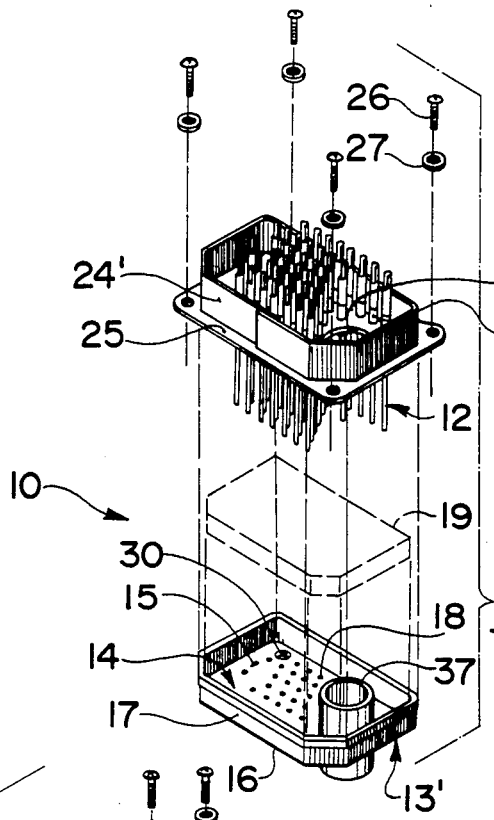
FIG. 8 is an exploded perspective view of the casing for the terminals, the epoxy potting compound (shown in broken lines), and the insert of the present invention, respectively, the view corresponding substantially to a portion of FIG. 1, but showing how the sleeve for the conventional coaxial cable (not shown herein) is formed integrally with the molded insert to electrically isolate the coaxial cable from the terminals of the connector.

With reference to FIG. 8, an alternate embodiment 13' of the insert is illustrated. The insert 13' has a sleeve 37 formed integrally therewith for accommodating and electrically isolating the coaxial cable from metal casing 24. The sleeve 37 on the insert 13' would thus be used in lieu of the sleeve 34 on the casing 24 (as shown in FIG. 1). In the assembled connector, sleeve 37 extends through opening 40 in casing 24.

Figure 9:
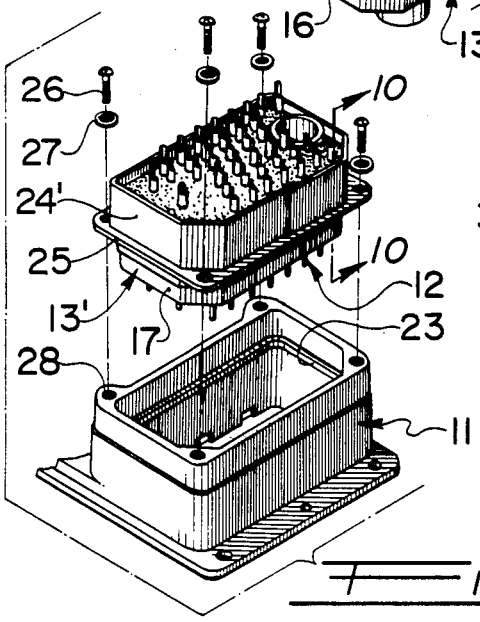
FIG. 9 is a further exploded perspective view, corresponding substantially to that of FIGS. 4 and 5, but showing the insert of the present invention removably secured to the casing for the terminals prior to assembly with the main housing of the connector, thereby facilitating testing and repair.
Figure 10:
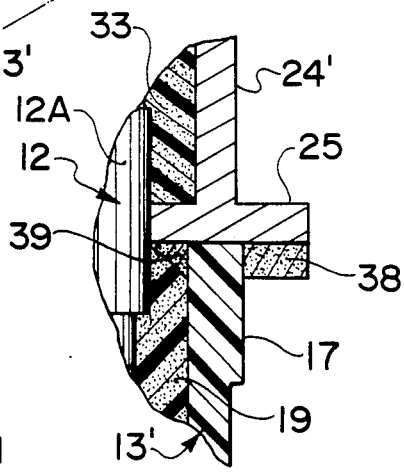
FIG. 10 is a section view, taken along the lines 10—10 of FIG. 9 and drawn to an enlarged scale, and showing an adhesive for removably securing the insert and casing subassembly to the main housing.

With reference to FIGS. 9 and 10, a further alternate embodiment of the present invention is illustrated, wherein the insert 13 is secured to the casing 24 to form a subassembly which is then removably secured to the housing 11 of the connector 10. The skirt 17 of the insert 13 is, secured to the flange 25 of the casing 24 by an adhesive 39. The subassembly is removably secured to housing 11 with adhesive 39. Preferably, the adhesive 38 is thermoplastic adhesive, which may be softened upon the application of heat thereto, thereby allowing the insert and casing subassembly with its terminals 12 to be lifted out of the housing 11 of the connector 10. It is desirable that the softening point of thermoplastic adhesive 38 be lower than that of adhesive 39. The subassembly arrangement facilitates testing of the terminals 12 in the insert 13 and casing 24 prior to assembly within the housing 11 of the connector 10 (during manufacture thereof) and further facilitates a convenient and economical repair and replacement of the subassembly out in the field.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An electrical connector comprising:

a housing having a plurality of spaced-apart substantially-parallel terminals mounted therein;

an insert disposed within the housing, the insert having a base portion provided with a plurality of spaced-apart openings to receive the terminals, respectively, the base portion having first and second sides, the insert further having a peripheral skirt portion extending from the first side of the base portion thereof;

a potting compound encapsulating the terminals within the skirt portion of the insert and substantially against the first side of the base portion thereof, said potting compound being retained within said skirt portion and spaced from said housing by said peripheral skirt portion; and an interfacial seal having a plurality of spaced-apart openings formed therein for the terminals, the interfacial seal being disposed substantially flat against the second side of the base portion of the insert, thereby providing an effective seal when the connector is mated with a complementary connector and to preclude moisture from accumulating within the potting compound.

2. The electrical connector of claim 1, wherein the housing has an internal peripheral rib formed therein, and wherein the skirt portion of the insert is seated on the peripheral rib in the housing.

3. The electrical connector of claim 1, wherein the base portion of the insert has an opening formed therein, whereby the potting compound may be inserted from the second side of the base portion of the insert.

4. The electrical connector of claim 1, wherein the terminals are mounted in a casing having a peripheral flange portion secured to the housing, wherein the casing has a bottom wall covering the insert and the potting compound therein; and wherein a potting compound is disposed within the casing for encapsulating the terminals therein.

5. The electrical connector of claim 1, wherein the potting compound comprises an epoxy.

6. The electrical connector of claim 1, wherein the interfacial seal is substantially flat and flexible and is molded from an elastomeric material.

7. The electrical connector of claim 1 wherein said terminals include filter members disposed thereon.

8. The electrical connector of claim 1, wherein said insert is removably secured within said housing, thus permitting said insert with said encapsulated terminals to be removed from the housing.

9. In an electrical connector comprising:

a housing having a plurality of spaced-apart substantially-parallel terminals mounted therein;

an insert disposed within the housing, the insert having a base portion provided with a plurality of spaced-apart openings to receive the terminals, respectively, the base portion having first and second sides, the insert further having a peripheral skirt portion extending from the first side of the base portion thereof, the housing having an internal peripheral rib formed therein, the skirt portion of the insert being seated on the peripheral rib in the housing;

a potting compound encapsulating the terminals within the skirt portion of the insert, the potting compound being disposed substantially against the first side of the base portion of the insert, said potting compound being retained within said skirt portion and spaced from said housing by said peripheral skirt portion, the base portion of the insert having an opening formed therein for receiving the potting compound inserted form the second side of the base portion of the insert; and a substantially-flat interfacial seal molded from an elastomeric material and having a plurality of spaced-apart openings formed therein for the terminals, the interfacial seal being disposed substantially flat against the second side of the base portion of the insert, thereby providing an effective seal, whereby the indentations in the potting compound that may result from the curing thereof do not contribute to the build-up of moisture, and whereby the substantially-flat engagement between the interfacial seal and the insert compensates for any indentations in the potting compound.

10. The electrical connector of claim 9 wherein said terminals include filter members disposed thereon.

11. In the electrical connector of claim 9 the connector further includes means for removably securing said insert within said housing, thus permitting said insert with said encapsulated terminals to be removed from the housing.

12. An electrical connector comprising:

a housing having a plurality of spaced-apart substantially-parallel terminals mounted therein, the terminals being carried by a casing having a flanged bottom wall secured to the housing;

an insert disposed within the housing, the insert having a base portion provided with a plurality of spaced-apart openings to receive the terminals, respectively, the insert further having a peripheral skirt portion extending from the base portion of the insert to the bottom wall of the casing; and a potting compound encapsulating the terminals within the skirt portion of the insert and substantially between the base portion of the insert and the bottom wall of the casing, said potting compound being retained within said skirt portion and spaced from said housing by said peripheral skirt portion.

13. The connector of claim 12 wherein said terminals include filter members disposed thereon.

14. A method of assembly of an electrical connector, comprising the steps of:

providing a casing having a plurality of spaced apart terminals carried thereby, such that the terminals project above and below a bottom wall of the casing;

providing an insert having a base portion and further having a skirt portion extending upwardly of its base portion;

securing the skirt portion of the insert to the bottom wall f the casing, such that the plurality of terminals projecting below the bottom wall of the casing extend through a corresponding plurality of openings formed in the base portion of the insert;

providing a housing;

securing the casing to the housing, such that the insert is disposed at least partially within the housing;

injecting a potting compound into the space between the base portion of the insert and the bottom wall of the casing for encapsulating the terminals;

providing an interfacial seal; and disposing the interfacial seal within the housing and substantially flush against the base portion of the insert on the side thereof opposite to the potting compound, thereby providing an effective seal to compensate for any indentions formed in the curing of the potting compound, and thereby precluding the accumulation of moisture within the indentations.

15. The method of claim 14 wherein at least one of said terminals includes a filter member disposed thereon.

16. The method of claim 14, wherein the interfacial seal comprises a substantially-flat flexible sealing member molded from an elastomeric material.

17. The method of claim 14, wherein the insert is secured to the casing by an adhesive.

18. The method of claim 17, wherein the bottom wall of the casing is provided with a flange, and wherein the skirt portion of the insert is adhesively secured to the flange on the bottom wall of the casing.

19. The method of claim 14, wherein the casing is secured to the housing by an adhesive.

20. The method of claim 19, wherein the adhesive is thermoplastic, such that upon the application of heat thereto, the casing may be removed from the housing, thereby facilitating testing and repair of the connector.

* * * * *